US009324520B2

(12) United States Patent
Gentsch

(10) Patent No.: US 9,324,520 B2
(45) Date of Patent: Apr. 26, 2016

(54) VACUUM CHAMBER WITH A ONE-PIECE METALLIC COVER FOR SELF-CENTERING

(71) Applicant: ABB Technology AG, Zurich (CH)

(72) Inventor: Dietmar Gentsch, Rantingen (DE)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 14/242,463

(22) Filed: Apr. 1, 2014

(65) Prior Publication Data

US 2014/0291293 A1 Oct. 2, 2014

(30) Foreign Application Priority Data

Apr. 2, 2013 (EP) ..... 13001668

(51) Int. Cl.
*H01H 33/662* (2006.01)

(52) U.S. Cl.
CPC ..... *H01H 33/66207* (2013.01); *H01H 2033/66215* (2013.01); *H01H 2033/66223* (2013.01)

(58) Field of Classification Search
CPC ..... H01H 33/66; H01H 9/02; H01H 33/662; H01H 33/66207
USPC ..... 218/118, 120, 134, 139, 140; 310/28
See application file for complete search history.

(56) References Cited

U.S. PATENT DOCUMENTS

| | | | | |
|---|---|---|---|---|
| 4,394,554 | A | 7/1983 | Warabi et al. | |
| 7,508,636 | B2 | 3/2009 | Sellier et al. | |
| 2004/0074874 | A1 | 4/2004 | Fieberg et al. | |
| 2006/0016787 | A1 * | 1/2006 | Stoving et al. | 218/118 |
| 2007/0007250 | A1 * | 1/2007 | Li | 218/134 |
| 2008/0272659 | A1 * | 11/2008 | Jeong et al. | 310/28 |

FOREIGN PATENT DOCUMENTS

| | | | |
|---|---|---|---|
| DE | 36 28 174 | A1 | 2/1988 |
| DE | 101 51 105 | C1 | 8/2002 |
| EP | 0 039 611 | A1 | 11/1981 |
| EP | 1 742 242 | B1 | 12/2008 |

OTHER PUBLICATIONS

Search Report mailed on Sep. 17, 2013, by the European Patent Office for Application No. 13001668.6.

* cited by examiner

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

The disclosure relates to a vacuum chamber including at least one ceramic isolating cylinder with two face ends. At least one of the two face ends of the ceramic isolating cylinder is closed by a metallic cover including an outer and an inner part. A distal end of the outer part of the metallic cover is thinner relative to the remainder of the outer part of the metallic cover and forms a metallic lid. The metallic lid is connected to at least one of the two face ends of the ceramic isolating cylinder in a vacuum tight manner. The metallic cover can be formed in one piece and fits with the inner part of the metallic cover at an inner girthed area of the ceramic isolating cylinder to realize a self-centering of the metallic lid to at least one of the two face ends of the ceramic isolating cylinder.

14 Claims, 2 Drawing Sheets

VACUUM CHAMBER WITH A ONE-PIECE METALLIC COVER FOR SELF-CENTERING

RELATED APPLICATION(S)

This application claims priority to European Patent Application 13001668.6 filed in Europe on Apr. 2, 2014. The entire contents of this application are hereby incorporated by reference in its entirety.

FIELD

The disclosure relates to a vacuum chamber including at least one ceramic isolating cylinder with two face ends. At least one of the two face ends of the ceramic isolating cylinder is closed by a metallic cover having an outer and an inner part. A distal end of the outer part of the metallic cover is thinner relative to the remainder of the outer part of the metallic cover and forms a metallic lid. The metallic lid is connected to at least one of the two face ends of the ceramic isolating cylinder in a vacuum tight manner.

BACKGROUND INFORMATION

Such vacuum chambers can be used in a switchgear assembly whose gas, such as air, is an insulating gas that can be at atmospheric pressure. Consequently, an insulating cylinder, covers and a bellow can be configured in terms of strength for atmospheric pressure. Cases are conceivable in which the vacuum chamber is installed in a switchgear assembly whose pressure is substantially increased, for example, up to approximately 25 bars, with the result that the parts as mentioned before should all be configured such that they withstand this pressure.

Known circuit breakers provide protection for electrical systems from electrical fault conditions such as current overloads, short circuits, and low level voltage conditions. Circuit breakers can include a spring-powered operating mechanism which opens electrical contacts inside a vacuum interrupter to interrupt the current flowing through the conductors in an electrical system in response to abnormal conditions. Vacuum interrupters can include separable main contacts disposed within an insulated and hermetically sealed vacuum chamber.

The vacuum chamber can include one or more sections of ceramics for electrical insulation and one or more metal components to form an envelope in which a vacuum may be drawn. The metal components can be easily formed and can provide a structural strength lacking in the ceramic components. The ceramic shell can be cylindrical. However, other cross-sectional shapes can be used. The metal components can include two end caps and, where there are multiple ceramic sections, one or more external center shields disposed between the ceramic sections.

EP 1 742 242 B1 discloses a metal component for a vacuum chamber of a circuit breaker, wherein the vacuum chamber has at least one electrically insulating hollow body. The metal component includes a body structured to be coupled to the hollow body, and a sealing edge extending from the body. The sealing edge has a distal tip with a sealing surface, and a gradual reduction in cross-sectional thickness between the body and the sealing surface, so that the sealing surface is the thinnest portion of the sealing edge. The sealing edge is generally circular with the inner and outer surfaces thereof defined by respective inner and outer diameters. The gradual reduction in cross-sectional thickness is created by the inner and outer diameters becoming respectively smaller and larger as measured from a point adjacent to the sealing surface to a point adjacent to the body.

U.S. Pat. No. 7,508,636 B2 relates to a vacuum chamber with at least one insulating cylinder made of ceramic material. The face ends of the ceramic insulating cylinder are closed off by a cover, each with a movable contact element attached to a movable contact stem and with a fixed contact element attached to a fixed contact stem, which each penetrate the cover. Furthermore, a vacuum-tight sealing element is fastened between the one cover and the movable contact stem and permits a movement of the contact stem. The covers are tightly soldered or brazed to the respective face end of the adjacent insulating cylinder by interposing at least one supporting ring. The sealing element is fastened to the cover and the contact stem. The covers are provided with a cup-like arrangement and include an edge which is thinner relative to the remainder of the area. The sealing element includes two or more layers which are connected, and especially welded or brazed, with their free ends in a vacuum-tight manner with each other and with the cover and the contact stem, respectively.

SUMMARY

A vacuum chamber is disclosed including at least one ceramic isolating cylinder with two face ends; and a metallic cover configured for closing at least one of the two face ends of the ceramic isolating cylinder, the metallic cover including an outer part and an inner part, wherein a distal end of the outer part of the metallic cover is thinner relative to a remainder of the outer part of the metallic cover and forms a metallic lid, wherein the metallic lid is connected to at least one of the two face ends of the ceramic isolating cylinder in a vacuum tight manner, wherein the metallic cover is formed in one piece and an inner part of the metallic cover fits with an inner girthed area of the ceramic isolating cylinder to realize a self-centering of the metallic lid to at least one of the two face ends of the ceramic isolating cylinder.

A medium voltage vacuum circuit breaker is disclosed, comprising: at least one ceramic isolating cylinder with two face ends; a metallic cover configured for closing at least one of the two face ends of the ceramic isolating cylinder, the metallic cover including: an outer part and an inner part, wherein a distal end of the outer part of the metallic cover is thinner relative to a remainder of the outer part of the metallic cover and forms a metallic lid, wherein the metallic lid is connected to at least one of the two face ends of the ceramic isolating cylinder in a vacuum tight manner, wherein the metallic cover is formed in one piece and an inner part of the metallic cover fits with an inner girthed area of the ceramic isolating cylinder to realize a self-centering of the metallic lid to at least one of the two face ends of the ceramic isolating cylinder; and an actuator for generating an operation force for transmission via a jackshaft arrangement to a vacuum interrupter with a vacuum chamber of the vacuum circuit breaker.

BRIEF DESCRIPTION OF THE DRAWINGS

In the following, the disclosure will be described in greater detail by reference to exemplary embodiments and with reference to the attached drawings, in which.

The reference symbols used in the drawings, and their meanings, are listed in summary form in the list of reference symbols. In principle, identical parts are provided

DETAILED DESCRIPTION

Figure 1:
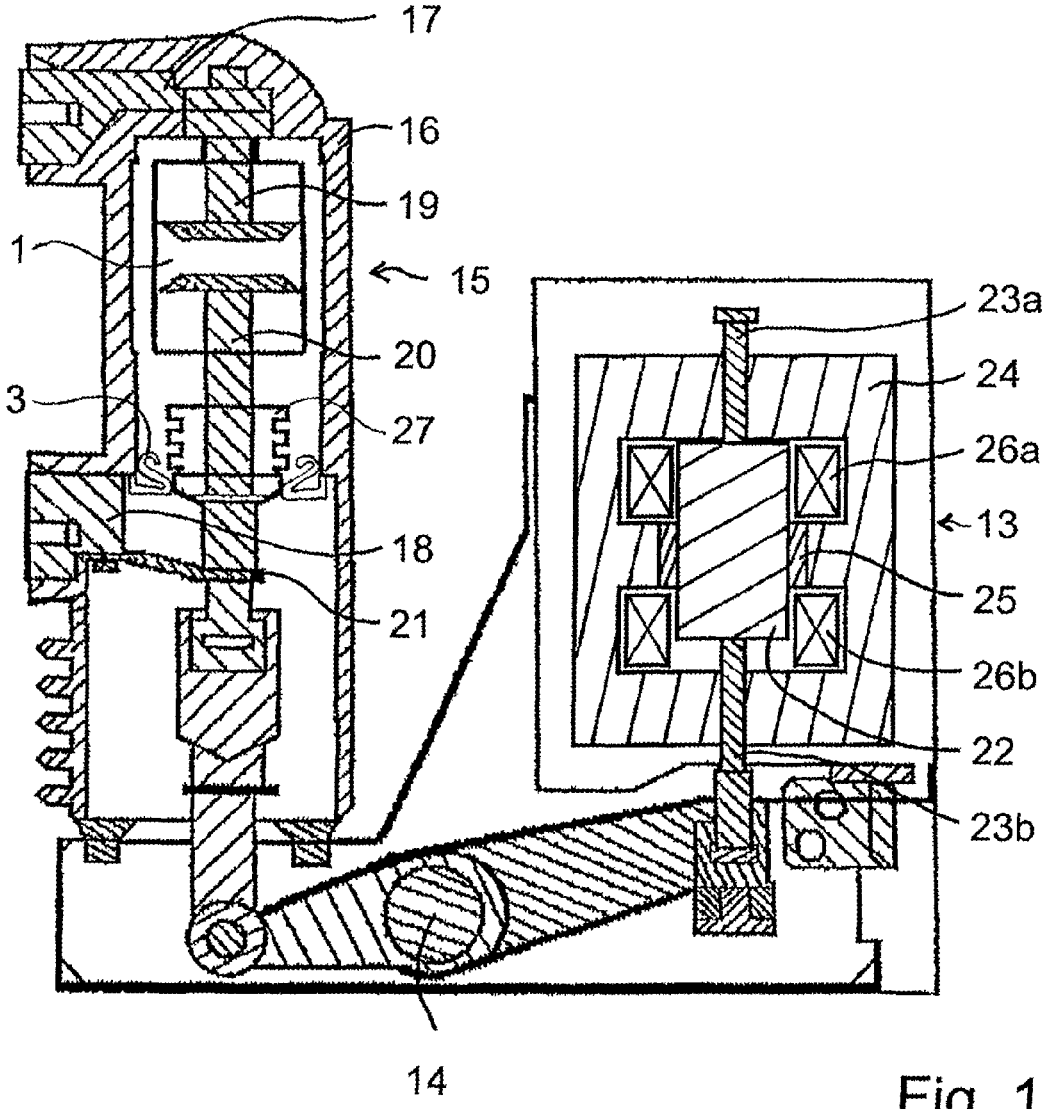
FIG. 1 shows a longitudinal cut through a medium voltage vacuum circuit breaker including a vacuum interrupter with a vacuum chamber according to an exemplary embodiment of the disclosure.

Exemplary embodiments of the present disclosure provide a vacuum chamber with a metallic cover which can make available fast and automated assembling of the metallic cover on the vacuum chamber and which can reduce production costs.

According to an exemplary embodiment of the disclosure, the metallic cover can be formed in one piece and fits with the inner part of the metallic cover at an inner girthed area of the ceramic isolating cylinder to realize a self-centering of the metallic lid to at least one of the two face ends of the ceramic isolating cylinder. Thus, the inner part of the metallic cover can be used for self-centering. An advantage is that the metallic cover is formed in one piece what makes it possible to use advantageous production processes. The metallic cover can be made from, for example, a stainless steel material which is formed by deep drawing, rolling or spinning. Furthermore, fast and automated assembling of the metallic cover on the vacuum chamber is possible and reduces material, assembling time and, therefore, costs.

An exemplary embodiment of the metallic cover according to the disclosure can include three parts. A first part includes a metallic lid and extends axially away from at least one of the two face ends of the ceramic isolating cylinder. A second part extends radial away from the first part towards an interior of the at least one ceramic isolating cylinder. A third part extends in a combination of radial and axial direction towards the girthed area of the at least one ceramic isolating cylinder. The three parts are not joined together, but formed from one piece. One further possibility will be the use of a compensation layer in between of the metal part and the ceramic by the use of copper material.

According to an exemplary embodiment according to the disclosure, the metallic cover can include four parts. A first part includes the metallic lid and extends axially away from at least one of the two face ends of the ceramic isolating cylinder. A second part extends radial away from the first part towards the interior of the at least one ceramic isolating cylinder. A third part extends basically parallel to the first part axially towards the interior of the at least one ceramic isolating cylinder. A fourth part extends basically parallel to the second part axially towards the girthed area of the at least one ceramic isolating cylinder. The four parts are as well as the three parts not joined together, but formed from one piece.

However, it is possible to shape the metallic cover in many different ways to achieve the effect of the disclosure.

According to an exemplary embodiment of the vacuum chamber according to the disclosure, a distal end of the inner part of the metallic cover is provided with a rounded shape for avoiding voltage peaks.

The metallic lid can be connected to at least one of the two face ends of the ceramic isolating cylinder by soldering or brazing. Furthermore, it is imaginable to connect the ceramic isolating cylinder by other joining techniques for example, welding and glueing. Moreover, brazing foil is a further possibility to connect these two parts. Micro-plastic deformation will be taken from the brazing material.

Furthermore, the metallic lid can have a wall thickness of 0.4 mm or less in the area where it is connected to the at least one of the two face ends of the ceramic isolating cylinder. This provides a low thermal expansion in the connection area.

In addition, the vacuum chamber is part of a vacuum interrupter of a medium voltage vacuum circuit breaker, including an actuator for generating an operation force wherein the operation force is transmitted via a jackshaft arrangement to the vacuum interrupter.

Figure 3:
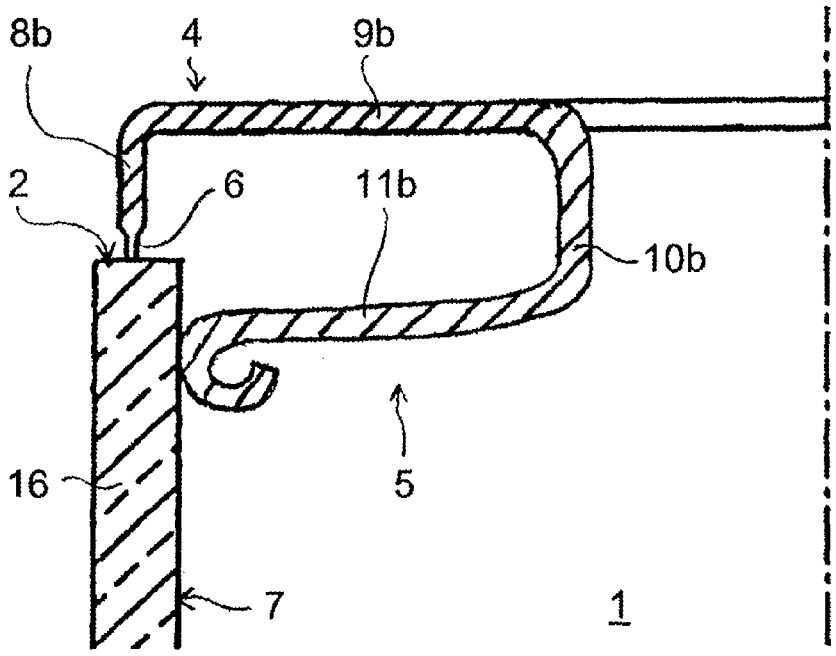
FIG. 3 shows a fragmented, sectional view through an exemplary embodiment of the vacuum chamber with a metallic cover according to the disclosure.

The metallic lid can have a wall thickness of 0.4 mm or less in the area where it is connected to the at least one of the two face ends of the ceramic isolating cylinder and there will be a compensation layer between the metallic lid and the surface, like shown in FIG. 3.

FIG. 1 shows a medium voltage vacuum circuit breaker 12 which includes a ceramic isolating cylinder 16 with an embedded upper electrical terminal 17 and a lower electrical terminal 18 forming an electrical switch for a medium voltage circuit. Therefore, the upper electrical terminal 17 is connected to a corresponding fixed upper electrical contact 19 which is mounted in a vacuum chamber 1 of a vacuum interrupter 15. The vacuum chamber 1 is closed by a metallic cover 3 which is arranged on a face end 2 of the ceramic isolating cylinder 16 and a bellow 27 which is arranged between the metallic cover 3 and a contact stem of a movable lower electrical contact 20. The lower electrical contact 20 is movably mounted in relation to the vacuum interrupter 15. The lower electrical terminal 18 is connected to the corresponding movable lower electrical contact 20. The movable lower electrical contact 20 is movable between a closed and opened switching position via a jackshaft arrangement 14. A flexible conductor 21 of copper material is provided in order to electrically connect the lower electrical terminal 18 with the movable lower electrical contact 20.

The jackshaft arrangement 14 internally couples the mechanical energy of an electromagnetic actuator 13 to the ceramic isolating cylinder 16 of the vacuum interrupter 15. The electromagnetic actuator 13 includes a movable ferromagnetic plunger 22 which is guided by two axes 23*a* and 23*b* in a ferromagnetic frame 24. A permanent magnet 25 is arranged on an inner extent area of the ferromagnetic frame 24 to create a magnetic flux so that the movable ferromagnetic plunger 22 is tightly held in one of the two end positions. Two coils 26*a* and 26*b*, one at the top and the other at the bottom of the ferromagnetic frame 24, are partially arranged inside the ferromagnetic frame 24 and can be used to modify the magnetic flux in a way that the movable ferromagnetic plunger 22 can move from a top position to a bottom position. The movable ferromagnetic plunger 22 at the top position represents an open position of the medium voltage vacuum circuit breaker 12.

Figure 2:
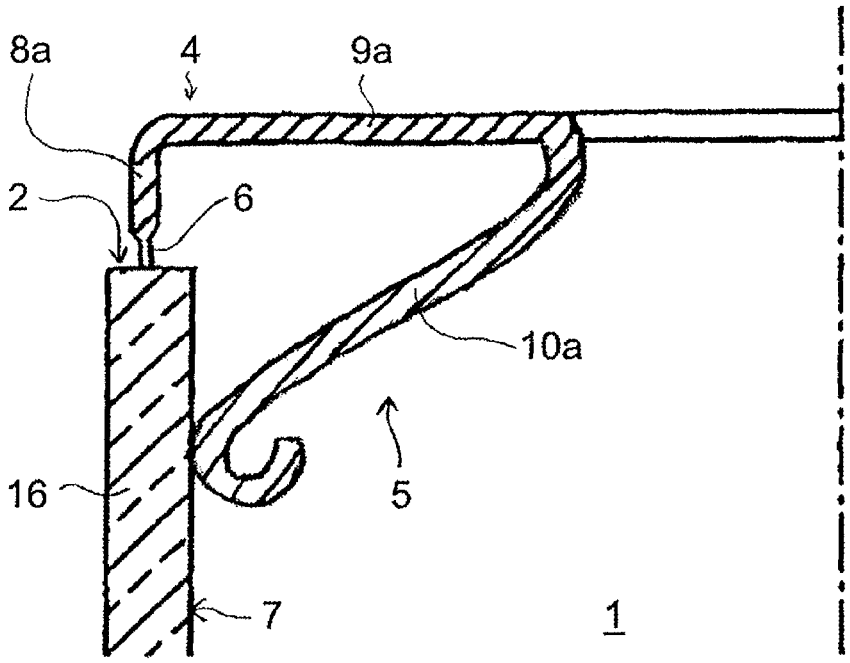
FIG. 2 shows a fragmented, sectional view through the vacuum chamber with a metallic cover according to FIG. 1.

FIG. 2 shows a detail of a vacuum chamber 1 according to an exemplary embodiment of the present disclosure including a ceramic isolating cylinder 16. The vacuum chamber 1 is closed by the metallic cover 3 which is arranged on the face end 2 of the ceramic isolating cylinder 16. The metallic cover 3 includes an outer and an inner part 4, 5, wherein a distal end of the outer part 4 of the metallic cover 3 is thinner relative to the remainder of the outer part 4 of the metallic cover 3 and forms a metallic lid 6. The metallic lid 6 is connected to the face end 2 of the ceramic isolating cylinder 16 in a vacuum tight manner by soldering. Furthermore, the metallic lid 6 has a wall thickness of 0.2 mm in the area where it is connected to the face end 2 of the ceramic isolating cylinder 1. The metallic cover 3 is formed in one piece and fits with the inner part 5 of the metallic cover 3 at an inner girthed area 7 of the ceramic isolating cylinder 16 to realize a self-centering of the metallic lid 6 to the face end 2 of the ceramic isolating cylinder 16.

The metallic cover 3 can include three parts 8*a*, 9*a*, 10*a*. A first part 8*a* includes the metallic lid 6 and extends axially away from at least one of the two face ends 2 of the ceramic isolating cylinder 1. A second part 9*a* extends radial away from the first part 8*a* towards an interior of the at least one ceramic isolating cylinder 1. A third part 10*a* extends in a combination of radial and axial direction towards the girthed area 7 of the ceramic isolating cylinder 1. A distal end of the inner part 5 of the metallic cover 3 is provided with a rounded shape to avoid voltage peaks. The fitting with the inner part 5 of the metallic cover 3 at the inner girthed area 7 of the ceramic isolating cylinder 16 realizes a self-centering of the metallic lid 6 to the face end 2 of the ceramic isolating cylinder 16.

FIG. 3 shows a detail of an exemplary embodiment of the vacuum chamber 1 with the metallic cover 3 according to the disclosure. The metallic cover 3 shown in FIG. 3 can include four parts 8*b*, 9*b*, 10*b*, 11*b*. A first and a second part 8*b* and 9*b* of the four parts 8*b*, 9*b*, 10*b*, 11*b* can be identical to the first and second part 8*a* and 9*a* in FIG. 2. The first part 8*b* includes the metallic lid 6 and extends axially away from the face end 2 of the ceramic isolating cylinder 1. The second part 9*b* extends radial away from the first part 8*b* towards the interior of the ceramic isolating cylinder 1. A third part 10*b* extends basically parallel to the first part 8*b* axially towards the interior of the ceramic isolating cylinder 1, and a fourth part 11*b* extends basically parallel to the second part 9*b* axially towards the girthed area 7 of the ceramic isolating cylinder 1. The fitting with the inner part 5 of the metallic cover 3 at the inner girthed area 7 of the ceramic isolating cylinder 16 realizes a self-centering of the metallic lid 6 to the face end 2 of the ceramic isolating cylinder 16.

FIG. 2 and FIG. 3 are simplified views and focus on the ceramic isolating cylinder 1 and the metallic cover 3. Thus, the bellow 27 shown in FIG. 1, which is arranged between the metallic cover 3 and the contact stem of the movable lower electrical contact 20, is not shown in FIG. 2 and FIG. 3.

While the disclosure has been illustrated and described in detail in the drawings and foregoing description, such illustration and description are to be considered illustrative or exemplary and not restrictive; the disclosure is not limited to the disclosed embodiments. Other variations to the disclosed embodiments can be understood and effected by those skilled in the art and practicing the claimed disclosure, from a study of the drawings, the disclosure, and the appended claims. In particular, the vacuum chamber 1 could be part of a low voltage vacuum circuit breaker. In this case, the metallic lid 6 can be made from a plastic material which is formed by injection molding.

In FIG. 3, there can be arranged an additional part between the lid 6 and face end 2 for compensation such as a copper material.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SIGNS

1 vacuum chamber
2 face end
3 metallic cover
4 outer part
5 inner part
6 metallic lid
7 inner girthed area
8*a*, 8*b* first part
9*a*, 9*b* second part
10*a*, 10*b* third part
11*b* forth part
12 vacuum circuit breaker
13 actuator
14 jackshaft arrangement
15 vacuum interrupter
16 ceramic isolating cylinder
17 upper electrical terminal
18 lower electrical terminal
19 upper electrical contact
20 lower electrical contact
21 flexible conductor
22 ferromagnetic plunger
23*a*, 23*b* axis
24 ferromagnetic frame
25 permanent magnet
26*a*, 26*b* coil
27 bellow

What is claimed is:

1. A vacuum chamber comprising:

at least one ceramic isolating cylinder with two face ends; and a metallic cover configured for closing at least one of the two face ends of the ceramic isolating cylinder, the metallic cover including:

an outer part and an inner part, wherein a distal end of the outer part of the metallic cover is thinner relative to a remainder of the outer part of the metallic cover and forms a metallic lid, wherein the metallic lid is connected to at least one of the two face ends of the ceramic isolating cylinder in a vacuum tight manner, wherein the metallic cover is formed in one piece and an inner part of the metallic cover fits with an inner girthed area of the ceramic isolating cylinder to realize a self-centering of the metallic lid to at least one of the two face ends of the ceramic isolating cylinder, and wherein the metallic cover comprises:

four parts, wherein a first part includes the metallic lid and extends axially away from at least one of the two face ends of the ceramic isolating cylinder, a second part extends radially away from the first part towards the interior of the at least one ceramic isolating cylinder, a third part extends basically parallel to the first part axially towards the interior of the at least one ceramic isolating cylinder, and a fourth part extends basically parallel to the second part, axially towards the girthed area of the at least one ceramic isolating cylinder.

2. The vacuum chamber of claim 1, wherein the metallic cover is made from a stainless steel material.

3. The vacuum chamber of claim 1, wherein the metallic cover is a deep drawn, rolled, or spun cover.

4. The vacuum chamber of claim 1, wherein a distal end of the inner part of the metallic cover is of a rounded shape.

5. The vacuum chamber of claim 1, comprising:

a soldered or brazed connection of the metallic lid to at least one of the two face ends of the ceramic isolating cylinder.

6. The vacuum chamber of claim 1, wherein the metallic lid has a wall thickness of 0.4 mm or less in the area where it is connected to the at least one of the two face ends of the ceramic isolating cylinder.

7. The vacuum chamber of claim 6, comprising:

a compensation layer between the metallic lid and at least one of the two face ends.

8. A medium voltage vacuum circuit breaker, comprising:

at least one ceramic isolating cylinder with two face ends;

a metallic cover configured for closing at least one of the two face ends of the ceramic isolating cylinder, the metallic cover including:

an outer part and an inner part, wherein a distal end of the outer part of the metallic cover is thinner relative to a remainder of the outer part of the metallic cover and forms a metallic lid, wherein the metallic lid is connected to at least one of the two face ends of the ceramic isolating cylinder in a vacuum tight manner, wherein the metallic cover is formed in one piece and an inner part of the metallic cover fits with an inner girthed area of the ceramic isolating cylinder to realize a self-centering of the metallic lid to at least one of the two face ends of the ceramic isolating cylinder and wherein the metallic cover comprises:

four parts, wherein a first part includes the metallic lid and extends axially away from at least one of the two face ends of the ceramic isolating cylinder, a second part extends radially away from the first part towards the interior of the at least one ceramic isolating cylinder, a third part extends basically parallel to the first part axially towards the interior of the at least one ceramic isolating cylinder, and a fourth part extends basically parallel to the second part, axially towards the girthed area of the at least one ceramic isolating cylinder; and an actuator for generating an operation force for transmission via a jackshaft arrangement to a vacuum interrupter with a vacuum chamber of the vacuum circuit breaker.

9. The medium voltage vacuum circuit breaker of claim 8, wherein the metallic cover is made from a stainless steel material.

10. The medium voltage vacuum circuit breaker of claim 8, wherein the metallic cover is a deep drawn, rolled, or spun cover.

11. The medium voltage vacuum circuit breaker of claim 8, wherein a distal end of the inner part of the metallic cover is of a rounded shape.

12. The medium voltage vacuum circuit breaker of claim 8, comprising:

a soldered or brazed connection of at least one of the two face ends of the ceramic isolating cylinder.

13. The medium voltage vacuum circuit breaker of claim 8, wherein the metallic lid has a wall thickness of 0.4 mm or less in the area where it is connected to the at least one of the two face ends of the ceramic isolating cylinder.

14. The medium voltage vacuum circuit breaker of claim 8, comprising;

a compensation layer between the metallic lid and at least one of the two face ends.

* * * * *